US009109807B2

(12) United States Patent
Shih et al.

(10) Patent No.: US 9,109,807 B2
(45) Date of Patent: Aug. 18, 2015

(54) DEVICE FOR DESORPTION AND DEHUMIDIFICATION AND SYSTEM USING THE SAME

(71) Applicant: INDUSTRIAL TECHNOLOGY RESEARCH INSTITUTE, Hsin-Chu (TW)

(72) Inventors: Ming-Shiann Shih, Pingjhen (TW); Jau-Chyn Huang, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 432 days.

(21) Appl. No.: 13/720,922

(22) Filed: Dec. 19, 2012

(65) Prior Publication Data

US 2013/0167724 A1 Jul. 4, 2013

Related U.S. Application Data

(60) Provisional application No. 61/578,455, filed on Dec. 21, 2011.

(30) Foreign Application Priority Data

May 30, 2012 (TW) ..... 101119293 A

(51) Int. Cl.
*F24F 3/14* (2006.01)

(52) U.S. Cl.
CPC ..... *F24F 3/14* (2013.01); *F24F 3/1411* (2013.01)

(58) Field of Classification Search
CPC ..... F24F 3/14; F24F 3/1411
See application file for complete search history.

(56) References Cited

U.S. PATENT DOCUMENTS 4,094,652 A 6/1978 Lowther
4,193,774 A * 3/1980 Pilat ..... 95/71

(Continued)

FOREIGN PATENT DOCUMENTS

CN 2509491 Y 9/2002
CN 101293169 A 10/2008

(Continued)

OTHER PUBLICATIONS

Song et al., "Effects of adsorption and temperature on a nonthermal plasma process for removing VOCs", Journal of Electrostatics, vol. 55 pp. 189-201, 2022.

(Continued)

*Primary Examiner* — Christopher P Jones
(74) *Attorney, Agent, or Firm* — Rabin & Berdo, P.C.

(57) ABSTRACT

The present invention provides a device and system for desorption and dehumidification, comprising a conductive electrode, a moisture absorber, and a power source. The conductive electrode comprises a first surface and a second surface opposite to the first surface, and the first surface has a plurality of protrusion elements. The moisture absorber comprises a third surface formed on the plurality of protrusions. The power source provides power to the conductive electrode such that a uniform and stable micro-discharge phenomenon is generated thereby forming a continuous charge flow. The continuous charge flow can further generate an electrical interruption for depolarizing the attraction between the moisture molecules and moisture absorber whereby the moisture molecules can be desorbed from the moisture absorber more easily.

22 Claims, 11 Drawing Sheets

(56) References Cited

U.S. PATENT DOCUMENTS

| | | | | |
|---|---|---|---|---|
| 5,501,007 | A * | 3/1996 | Kuma | 29/846 |
| 6,111,636 | A | 8/2000 | Tuunanen | |
| 6,298,679 | B1 | 10/2001 | Cheng et al. | |
| 6,829,130 | B2 | 12/2004 | Tanaka et al. | |
| 6,875,282 | B2 | 4/2005 | Tanaka et al. | |
| 7,159,646 | B2 | 1/2007 | Dessiatoun et al. | |
| 7,276,097 | B2 | 10/2007 | Edo | |
| 7,645,542 | B2 | 1/2010 | Kase et al. | |
| 7,714,278 | B2 | 5/2010 | Boyle et al. | |
| 8,043,414 | B2 | 10/2011 | Jeng et al. | |
| 2004/0261620 | A1 | 12/2004 | Thompson | |
| 2010/0175557 | A1 | 7/2010 | Shih et al. | |

FOREIGN PATENT DOCUMENTS

| | | | |
|---|---|---|---|
| CN | 201223764 | Y | 4/2009 |
| CN | 101537302 | A | 9/2009 |
| CN | 101785952 | A | 7/2010 |
| CN | 101879438 | A | 11/2010 |
| JP | 1986187917 | | 8/1986 |
| JP | 1986209029 | | 9/1986 |
| JP | 2001-179037 | A | 7/2001 |
| JP | 2003184137 | A | 7/2003 |
| JP | 2004-232998 | A | 8/2004 |
| JP | 2004230369 | A | 8/2004 |
| JP | 2008055287 | A | 3/2008 |
| JP | 2009220094 | A | 10/2009 |
| TW | 152634 | | 2/1991 |
| TW | 228566 | | 8/1994 |
| TW | 229164 | | 9/1994 |
| TW | 320640 | | 11/1997 |
| TW | 328966 | | 4/1998 |
| TW | 99002 | | 5/1998 |
| TW | 339014 | | 8/1998 |
| TW | 350832 | | 1/1999 |
| TW | 358037 | | 5/1999 |
| TW | 368087 | | 8/1999 |
| TW | 382601 | B | 2/2000 |
| TW | 400303 | B | 8/2000 |
| TW | 402517 | B | 8/2000 |
| TW | 408091 | B | 10/2000 |
| TW | 436526 | B | 5/2001 |
| TW | 482694 | B | 4/2002 |
| TW | 487597 | B | 5/2002 |
| TW | 494216 | B | 7/2002 |
| TW | 494547 | B | 7/2002 |
| TW | 513322 | B | 12/2002 |
| TW | 516609 | U | 1/2003 |
| TW | 526088 | B | 4/2003 |
| TW | 526092 | B | 4/2003 |
| TW | 536578 | B | 6/2003 |
| TW | 536609 | B | 6/2003 |
| TW | 550111 | B | 9/2003 |
| TW | 575654 | B | 2/2004 |
| TW | 587110 | B | 5/2004 |
| TW | 590791 | B | 6/2004 |
| TW | M256481 | U | 2/2005 |
| TW | M257272 | U | 2/2005 |
| TW | I230244 | B | 4/2005 |
| TW | I242453 | B | 11/2005 |
| TW | 200539936 | | 12/2005 |
| TW | I255153 | B | 5/2006 |
| TW | I255257 | B | 5/2006 |
| TW | I255330 | B | 5/2006 |
| TW | I259891 | B | 8/2006 |
| TW | I264042 | B | 10/2006 |
| TW | I265261 | B | 11/2006 |
| TW | I269799 | | 1/2007 |
| TW | I283636 | B | 7/2007 |
| TW | I295193 | B | 4/2008 |
| TW | I296296 | B | 5/2008 |
| TW | I296942 | | 5/2008 |
| TW | 200836817 | A | 9/2008 |
| TW | 370471 | | 5/2009 |
| TW | I313618 | B | 8/2009 |
| TW | I314472 | B | 9/2009 |
| TW | 200940919 | A | 10/2009 |
| TW | 201037239 | A | 10/2010 |
| TW | I332565 | | 11/2010 |
| TW | I346969 | | 8/2011 |
| TW | I351500 | | 11/2011 |
| TW | M423247 | U1 | 2/2012 |
| TW | I361101 | | 4/2012 |
| TW | I364322 | | 5/2012 |
| TW | I364520 | | 5/2012 |

OTHER PUBLICATIONS

Okubo et al., "NOx Concentration Using Adsorption and Nonthermal Plasma Desorption", IEEE Transactions on Industry Applications, vol. 38, No. 5, pp. 1196-1203, Sep./Oct. 2002.

Yang et al., "Plasma Desorption and Decomposition", IEEE, pp. 1877-1883, 1998.

Kuroki et al., "Regeneration of Honeycomb Zeolite by Nonthermal Plasma Desorption of Toluene", IEEE Transactions on Industry Applications, vol. 45, No. 1, Jan./Feb. 2009.

Japan Patent Office, Notice of Allowance issued on Dec. 11, 2013.

* cited by examiner

DEVICE FOR DESORPTION AND DEHUMIDIFICATION AND SYSTEM USING THE SAME

CROSS-REFERENCE TO RELATED APPLICATION

This application claims priority to U.S. Provisional Application No. 61/578,455 filed on Dec. 21, 2011, the entire content of which is incorporated herein by reference.

This application also claims priority to Taiwan Patent Application No. 101119293 filed in the Taiwan Patent Office on May 30, 2012, the entire content of which is incorporated herein by reference.

TECHNICAL FIELD

The present disclosure relates to an absorption and regeneration technology, and more particularly, to a device for desorption and dehumidification and the system using the same.

BACKGROUND

Conventionally, the household dehumidifier uses a refrigerant compressor to condense the moisture in the air to achieve dehumidification. However, the use of refrigerant results in problems such as ozone layer depletion. Therefore, there is need in developing a novel dehumidification technique without using refrigerant.

Among all the dehumidifying technologies available today, there is a rotary adsorption dehumidification device, which requires neither the compressor nor the refrigerant. The rotary adsorption dehumidification device is able to adsorb moisture from indoor air through a moisture absorber, while enabling air to flow through an electric heater to be heated and then guided to flow through a regeneration side of the moisture absorber wheel for moisture desorption. Thereafter, the high-temperature high-humidity air at an outlet of the regeneration side is introduced into a heat exchanger for condensation while allowing the condensed moisture to be collected into a water-collecting box. Since the dehumidifying mechanism in the rotary adsorption dehumidification device is achieved through the use of a moisture absorber, not only the dehumidification performance of the adsorption dehumidification device is not restricted by ambient air temperature and moisture content, but also does not need to use any compressor as those conventional dehumidification devices did, and thus the dehumidifier is advantageous in low noise and low cost without using compressor and refrigerant.

SUMMARY

The present disclosure relates to a device for desorption and dehumidification and the system using the same, which utilizes a continuous charge flow generated from a single conductive electrode based upon the micro-discharge phenomenon for depolarizing the attraction between the moisture molecules and moisture absorber whereby the moisture molecules can be desorbed from the moisture absorber effectively.

The present disclosure relates to a device for desorption and dehumidification and the system using the same, in which a conductive electrode that is coated or wrapped by a moisture absorber is electrically energized by a voltage of 3000V to 20000V from a high-frequency transformer for causing a small current of about 100 mA to flow from the conductive electrode to its ambient atmosphere so as to create a corona discharge or glow discharge within a small ionized region around the conductive electrode. Thereby, moisture absorber is submerged in the small ionized region which is full of charged particles, so that the attraction of the moisture absorber to polar water molecules is electrically interrupted and reduced by the charged particles for enhancing the desorption of water molecules from the moisture absorber, and thus the moisture absorber is enabled to desorb a sufficient amount of water at low temperature or without being heated by hot air.

In an exemplary embodiment, the present disclosure provides a device for desorption and dehumidification, comprising a conductive electrode, a moisture absorber, and a power source. The conductive electrode is disposed inside a space full with a gas and comprises: a coarse first surface; and a second surface, arranged opposite to the first surface. The moisture absorber comprises: a third surface, disposed engaging to the coarse first surface; and a fourth surface, arranged opposite to the third surface. The power source is electrically connected to the conductive electrode for providing a voltage to the conductive electrode so as to induce a current to flow from the conductive electrode to the gas for creating a gas discharge event and consequently further enabling a corona layer filled with a plurality of charged particles to be formed covering the fourth surface.

In another exemplary embodiment, the present disclosure provides a dehumidification system with desorption ability, comprising: a rotation unit; and a plurality of dehumidifiers. Each humidifier is mounted on the rotation unit and is configured with a conductive electrode, a moisture absorber, and a power source. The conductive electrode is disposed inside a space full with a gas and comprises: a coarse first surface; and a second surface, arranged opposite to the first surface. The moisture absorber comprises: a third surface, disposed engaging to the coarse first surface; and a fourth surface, arranged opposite to the third surface. The power source is electrically connected to the conductive electrode for providing a voltage to the conductive electrode so as to induce a current to flow from the conductive electrode to the gas for creating a gas discharge event and consequently further enabling a corona layer filled with a plurality of charged particles to be formed covering the fourth surface.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

Figure 1A:
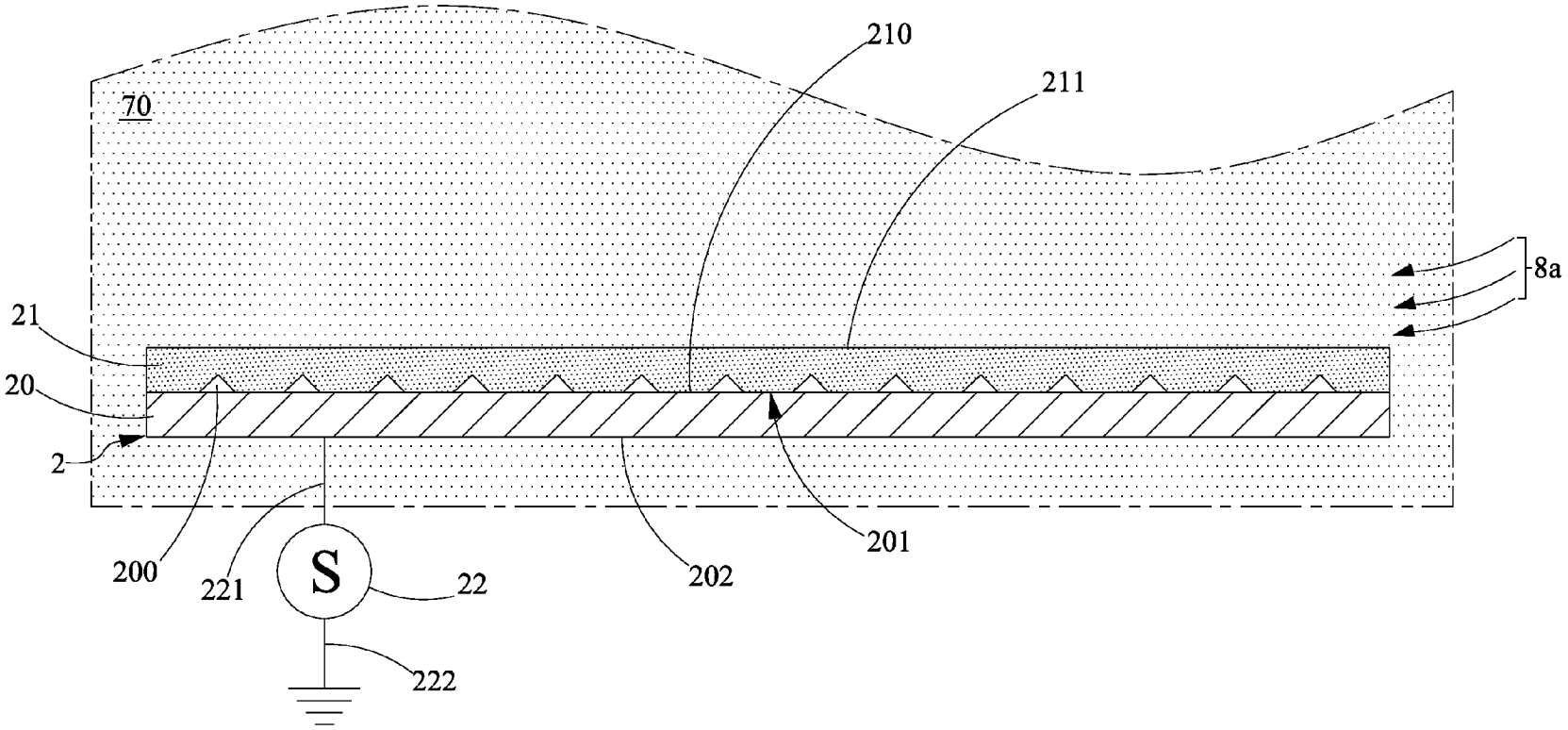
FIG. 1A is a schematic diagram showing a device for desorption and dehumidification according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 1C:
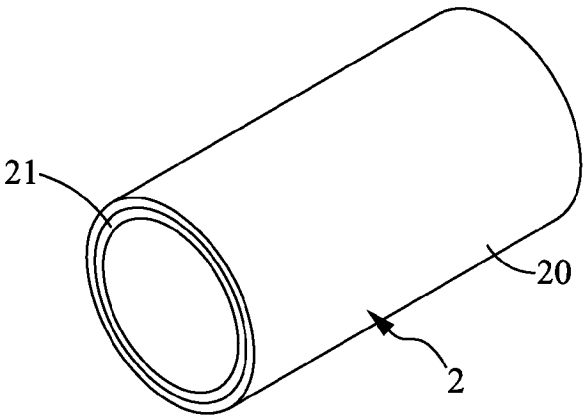
FIG. 1B and FIG. 1C are schematic diagrams respectively showing two different tube-like conductive electrodes of the present disclosure.
Figure 1B:
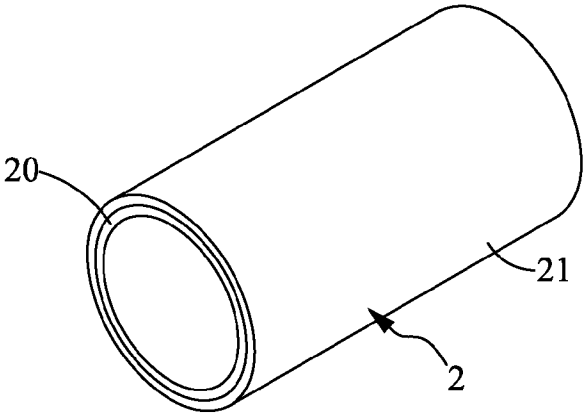

Please refer to FIG. 1A, which is a schematic diagram showing a device for desorption and dehumidification according to an embodiment of the present disclosure. The device for desorption and dehumidification 2 of FIG. 1A comprises: a conductive electrode 20, a moisture absorber 21, and a power source 22. The conductive electrode 20 is disposed inside a space 70 full with a gas and is configured with a first surface 201 and a second surface 202 opposite to the first surface 201. In the present disclosure, the conductive electrode can be made of a metal, an alloy, graphite or the mixture thereof, but is not limited thereby. Moreover, despite of the plate-like conductive electrode 20 shown in FIG. 1A, the conductive electrode can be formed as a tube, as the two tube-like electrodes shown in FIG. 1B and FIG. 1C. In addition, the space 70 can be an indoor space or an outdoor space, whichever is filled with gases.

Figure 2A:
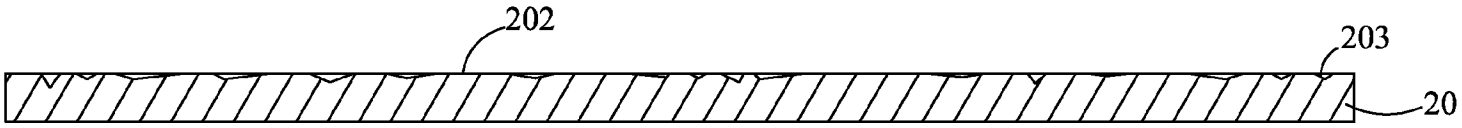
FIG. 2A and FIG. 2B are schematic diagrams respectively showing two different coarse first surfaces used in different embodiments of the present disclosures.
Figure 2B:
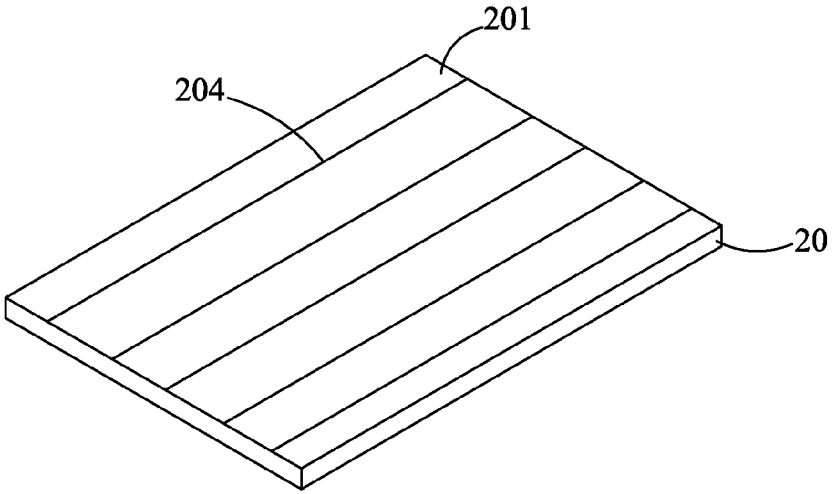

As shown in FIG. 1A, the first surface 201 of the conductive electrode 20 is a coarse surface configured with a plurality of tapered structures 200, whereas the plural tapered structures can be distributed in a regular manner or irregular manner. Please refer to FIG. 2A, which is a schematic diagram showing an exemplary coarse first surface used in the present disclosures. In the embodiment shown in FIG. 2A, the first surface 201 of the conductive electrode 20 is a coarse surface configured with a plurality of holes 203 that are distributed regularly or irregularly. To sum up, the first surface 201 is a coarse surface selected from the group consisting of: a surface configured with a plurality of holes, a surface configured with a plurality of tapered structures, and a surface configured with a plurality of holes and tapered structures; whereas the holes and the tapered structures can be distributed regularly or irregularly. Other than that, as shown in FIG. 2B, there can be a plurality of wire-like structures formed on the first surface 201 for constructing a coarse surface. It is noted that each of the wire-like structures is not required to be formed as a straight line, and it can be a curve or a zigzag line.

As shown in FIG. 1A, the moisture absorber 21 that is disposed inside the gas-filled space 70, is configured with: a third surface 210, disposed engaging to the coarse first surface 201; and a fourth surface 211, arranged opposite to the third surface 210. In this embodiment, the moisture absorber 21 is provided for allowing a moist gas flow 8*a* to flow therethrough while enabling the moisture containing in the gas flow 8*a* to be absorbed by the porous microstructure formed inside the moisture absorber 21. It is noted that the moisture absorber 21 is either being formed on the first surface 201 of the conductive electrode 20 by a means of coating, or is attached and covering tightly onto the first surface 201 of the conductive electrode 20. In this embodiment shown in FIG. 1A, the moisture absorber 21 is attached and covering tightly onto the first surface 201 of the conductive electrode 20. In the embodiment shown in FIG. 1B where the conductive electrode 20 is formed as a tube, the moisture absorber 21 is coated on or covered on the outer surface of the tube-like conductive electrode 20, and on the other hand, In the embodiment shown in FIG. 1C, the moisture absorber 21 is coated on or covered on the interior surface of the tube-like conductive electrode 20.

As shown in FIG. 1A, the power source 22 is electrically connected to the conductive electrode 20 through a high-voltage wire 221 while being grounded through another wire 222. Fir clarity, the high-voltage wire 221 and the ground wire 222 are symbolically illustrated, but are still clear to those skilled in the art. In this embodiment, the power source 22 is substantially a high-frequency transformer capable of producing a high voltage ranged between 3000V and 20000V, such as a current-limited high-frequency high-voltage AC power supply or a current-limited high-frequency high-voltage DC power supply. It is noted that the conductive electrode 20 that is shown in FIG. 1A is operating under the condition that it is not being electrically energized by the power source 22 so as to allow the moisture absorber 21 mounted thereon to absorb moisture containing in the gas flow 8*a*. Thus, after the absorption of the moisture absorber 21 is enabled for a period of time, the moisture absorber 21 should be desorbed and regenerated so as to keep absorbing moisture containing in the gas flow 8*a*.

Figure 1D:
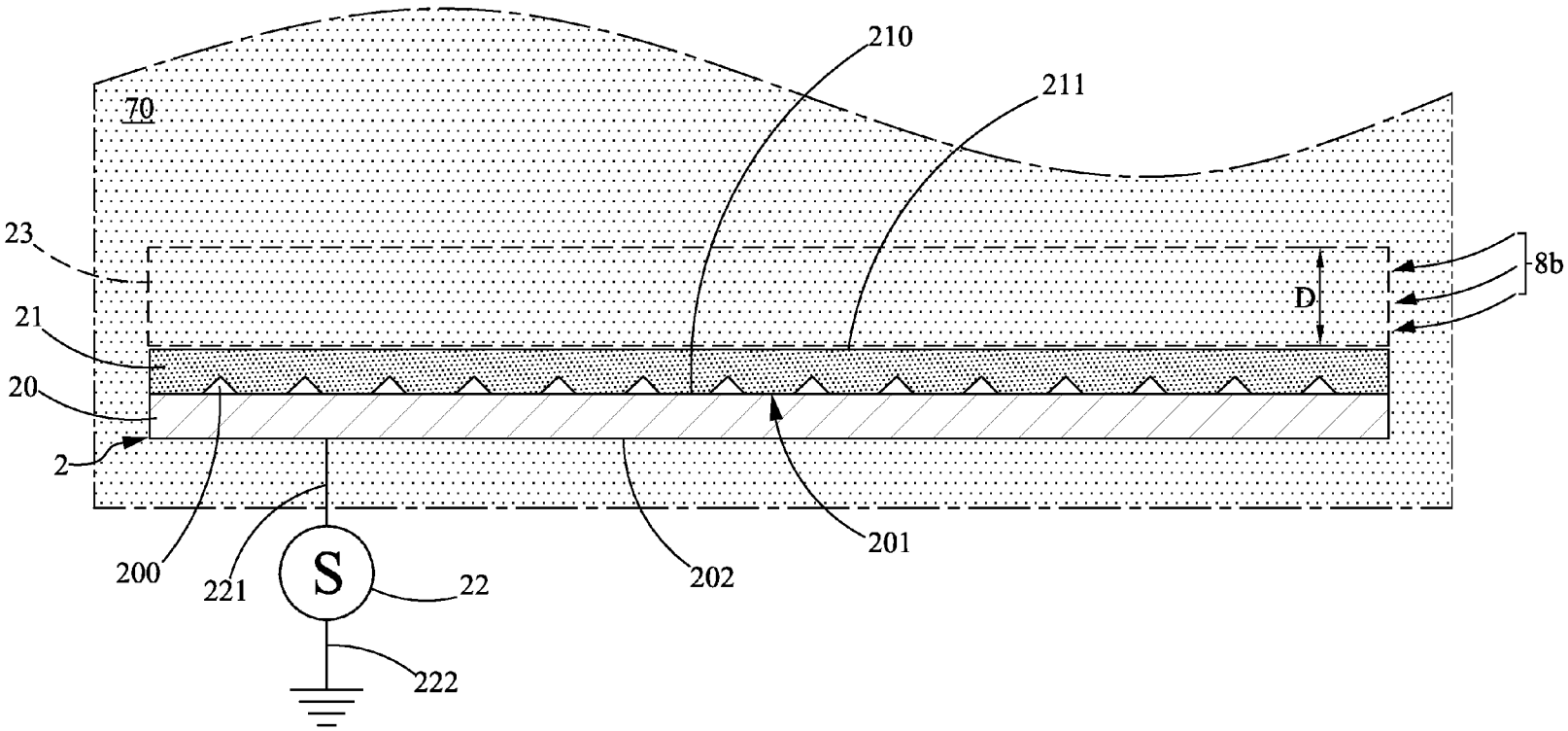
FIG. 1D is a schematic diagram showing how a corona layer is formed by the applying of a voltage to the conductive electrode from the power source in the present disclosure.

Please refer to FIG. 1D, which is a schematic diagram showing how a corona layer is formed by the applying of a voltage to the conductive electrode from the power source in the present disclosure. As shown in FIG. 1D, for desorbing the moisture absorber 21, the power source 22 will be enabled to provide a voltage to the conductive electrode 20 so as to induce a current to flow from the conductive electrode 20 by the help of the coarse first surface 201 to a gas in the space 70 in a direction normal to the first surface 201 for creating a gas discharge event and consequently enabling a corona layer filled with a plurality of charged particles to be formed covering the fourth surface 211. It is noted that the current from the conductive electrode 20 for the gas discharge event is ranged within 500 mA, but is not limited thereby. In this embodiment, the current is a current of 100 mA. Moreover, the gas discharge event is encouraged by the help of the coarse first surface 201 since the coarser a surface is, the easier a point discharge event can be induced. In addition, the corona layer is formed within a range extending upwardly and outwardly from the fourth surface 211 in a direction perpendicular to the fourth surface 211 by a corona distance D. In an exemplary embodiment of the present disclosure, the corona distance D is smaller than 2.5 cm.

As soon as the power source 22 is enabled to provide a high voltage to the conductive electrode 20, an electrical discharge is induced by the ionization of the gas surrounding the conductive electrode 20 that creates an ionization region 23. Consequently, the moisture contained in the moisture absorber 21 can be removed by the plasma of the ionization region 23 with the help of the air flow 8*b* blowing through the ionization region 23. Please refer to FIG. 3, which is a schematic diagram showing how the attraction of the moisture absorber to polar water molecules is electrically interrupted and reduced by the corona layer formed on the surface of the moisture absorber in the present disclosure. By the electric field effect 73 induced by the charged particles 72 in the corona layer 94, the attraction of the moisture absorber 21 to water molecules is electrically interrupted and reduced, and thus the moisture molecules can be desorbed from the moisture absorber 21 more easily.

In electricity, a corona discharge is an electrical discharge brought on by the ionization of a gas surrounding a conductor that is electrically energized. The discharge will occur when the strength (potential gradient) of the electric field around the conductor is high enough to form a conductive region, but not high enough to cause electrical breakdown or arcing to nearby objects. According to Paschen's law, the breakdown voltage of gas between parallel plates ais a function of pressure and gap distance. It is known from theory and experiment that at one standard atmosphere pressure and at a gap distance of 7.5 μm, the breakdown voltage is larger than 300 volts, and for every additional 1 mm of gap distance increased, the breakdown voltage should be raised by 400000 volts.

For a metal electrode with smooth surface, the corona discharge induced thereby to the nearby air is a stable nanosecond microdischarge that can occur spontaneously at any position on the smooth surface. Thus, there can be as many microdischarges evenly distributed in the surface of an insulator, e.g. an absorption material that is disposed wrapping the smooth metal electrode. However, corona discharge usually forms at highly curved regions on electrodes, such as sharp corners, projecting points, edges of metal surfaces, or small diameter wires. The high curvature causes a high potential gradient at these locations, so that the air breaks down and forms plasma there first, since the location with higher curvature is the location where the electric charge per unit area is higher and thus is the location with higher potential gradient. Accordingly, the conductive electrode in the present disclosure is formed with regular or irregular microstructures on its surface, such as a plurality of tapered structures or an array of needles that are disposed on the surface of the conductive electrode regularly or irregularly. By those microstructures, the corresponding charge density can be increase by at least 20 times, and consequently, for every additional 1 mm of gap distance increased, the breakdown voltage should be raised by about 800~2000 volts, while maintaining the same field intensity. In an exemplary embodiment, there is a plurality of tapered structures formed on the surface of the conductive electrode of the present disclosure, by that it is able to cause a corona discharge at 20000 volts whose corona layer has a discharge distance of 25 mm at maximum.

Figure 4A:
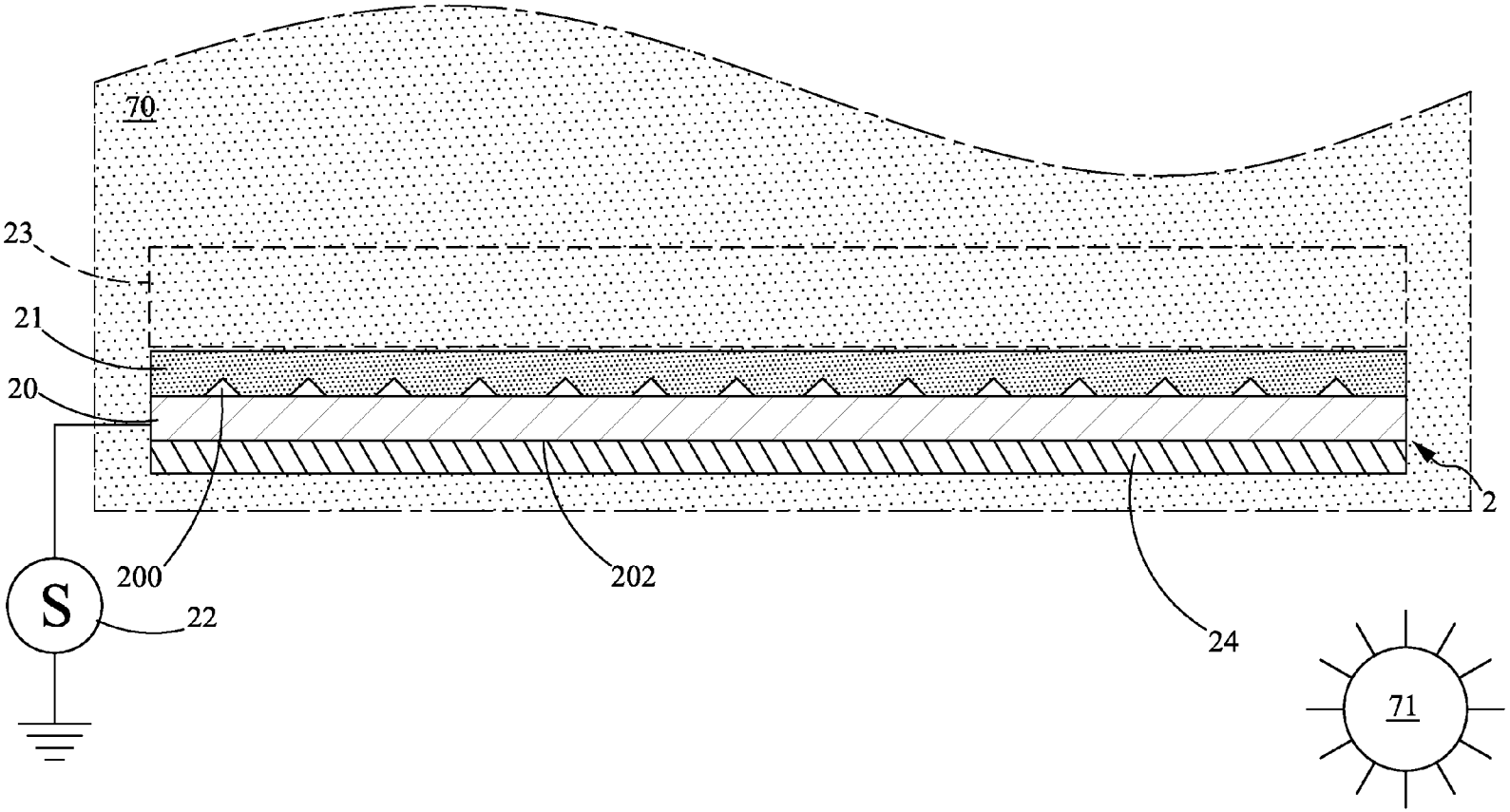
FIG. 4A is a schematic diagram showing a device for desorption and dehumidification according to another embodiment of the present disclosure.

FIG. 4A is a schematic diagram showing a device for desorption and dehumidification according to another embodiment of the present disclosure. The dehumidification device shown in FIG. 4A is basically the same as the one shown in FIG. 1A, but is different in that: the device for desorption and dehumidification 2 of FIG. 4A is additionally configured with a heating unit 24 that is coupled to the conductive electrode 20 for transmitting heat to the moisture absorber 21 through the conductive electrode 20. In this embodiment, the heating unit 24 is disposed on the second surface 202 of the conductive electrode 20 and is used for providing heat to the conductive electrode 20 where is further to be conducted to the moisture absorber 21. The power for the heating unit can be solar energy or electricity. Nevertheless, the energy used by the heating unit 24 of this embodiment is solar energy.

Figure 4B:
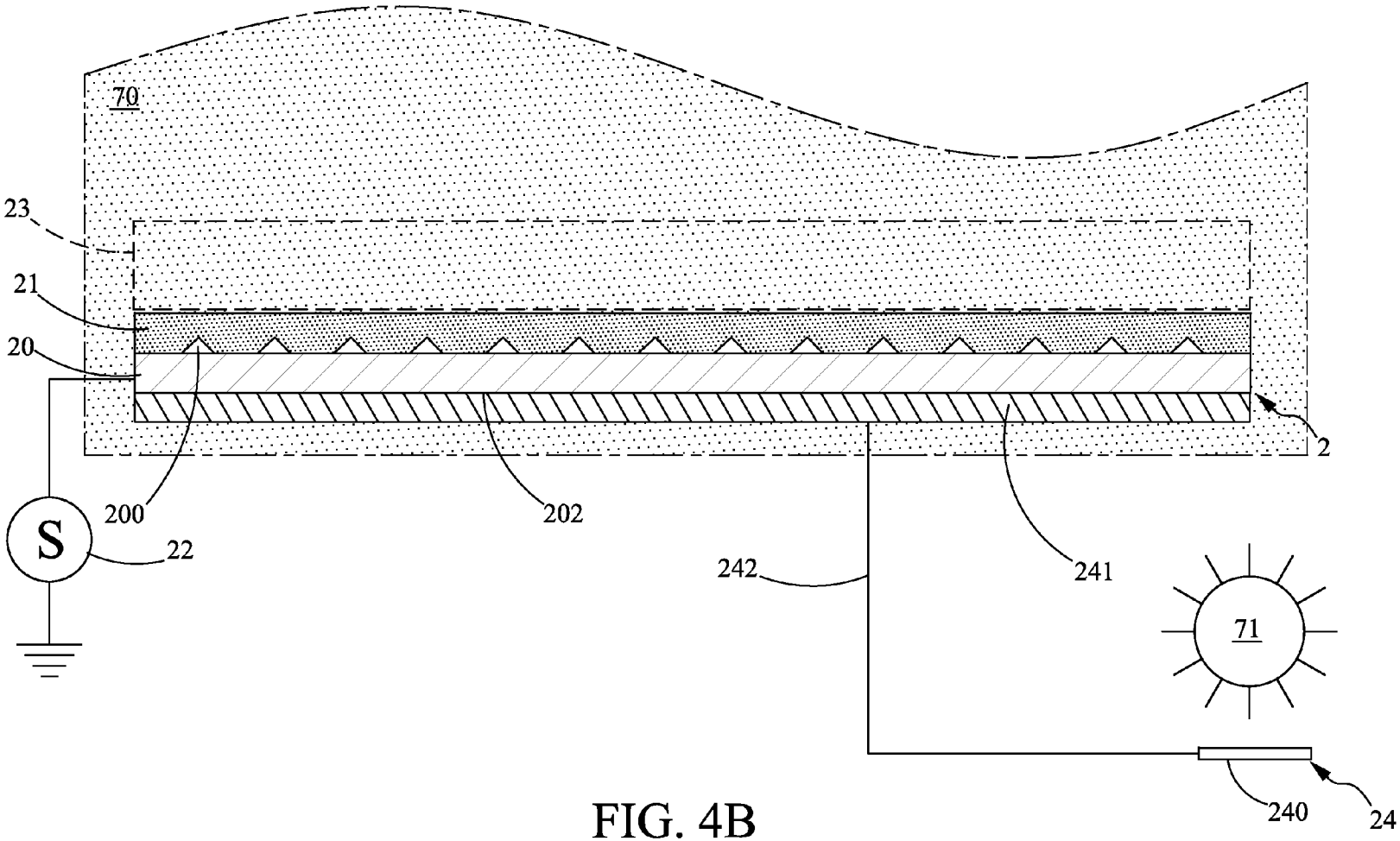
FIG. 4B is a schematic diagram showing a device for desorption and dehumidification using a heating unit that is different from the one shown in FIG. 4A.

It is noted that there can be various heating units 24 with different designs suitable for the present disclosure. As the embodiment shown in FIG. 4A, the heating unit 24 is substantially a solar energy-absorbing film capable of absorbing and converting solar energy from the Sun 71 into heat. Moreover, the solar energy-absorbing film can be made of a ceramic metal material, but is not limited thereby. Please refer to FIG. 4B, which is a schematic diagram showing a device for desorption and dehumidification using a heating unit that is different from the one shown in FIG. 4A. In this embodiment of FIG. 4B, the heating unit 24 comprises: a solar energy-absorbing film 240, a heat-conducting plate 241 and a thermal conductive element 242, in which the solar energy-absorbing film 240 is used for absorbing and converting solar energy from the Sun 71 into heat, the heat-conducting plate 241 is disposed engaging with the second surface 202 of the conductive electrode 20; and the thermal conductive element 242 is coupled to the solar energy-absorbing film 240 and the heat-conducting plate 241 for conducting the heat generated from the solar energy-absorbing film 240 to the heat-conducting plate 241. Moreover, the heat-conducting plate 241 and the thermal conductive element 242 are made of metals of high thermal conductivity. By the heat conducted from the solar energy-absorbing film 240, the flowing of the ionized gas in the corona layer is quickened and thus the moisture desorption of the moisture absorber can be accelerated so as to regenerate the moisture absorber.

Figure 5:
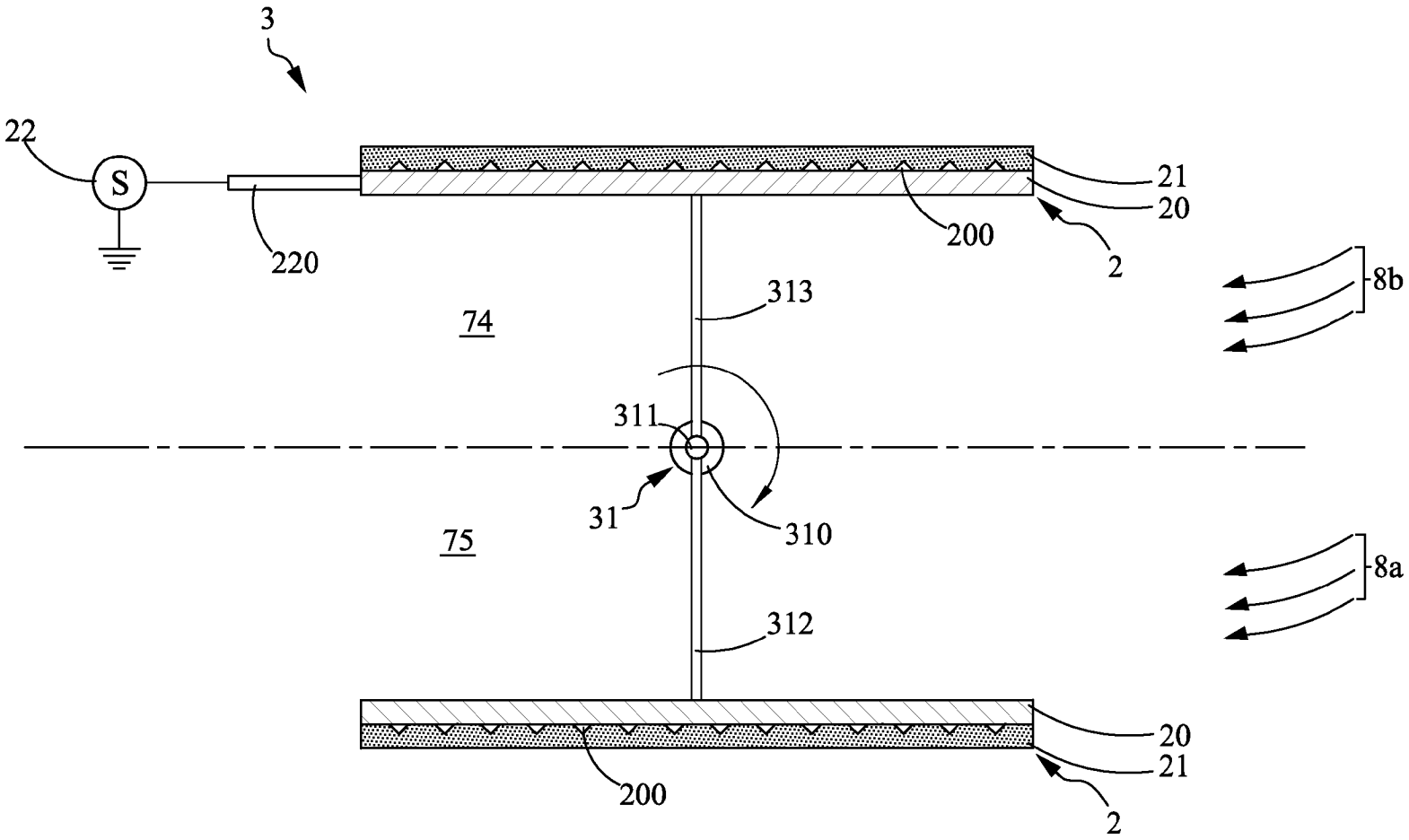
FIG. 5 is a schematic diagram showing dehumidification system with desorption ability according to a first embodiment of the present disclosure.

Please refer to FIG. 5, which is a schematic diagram showing dehumidification system with desorption ability according to a first embodiment of the present disclosure. In this first embodiment, the dehumidification system with desorption ability 3 comprises: a rotation unit 31; and a plurality of dehumidifiers 2. Each humidifier 2 is mounted on the rotation unit 31 and is configured the same as the one shown in the previous embodiments, and thus will not be described further herein. It is noted that power source 22 for the dehumidifiers 2 is fixed and thus is not movable. In this embodiment, the rotation unit 31 comprises: a driver 310 and a supporting element, in which the supporting element includes a pair of rods 312 and 313 that are arranged coupling to the driver 310. As shown in FIG. 5, the driver 310 is a motor, and the pair of rods 312 and 313 are respectively coupled to the rotation shaft 311 of the motor for receiving the force of rotation from the motor while being provided for supporting the plural dehumidifiers 2. It is noted that the two rods 312 and 313 can be made of a insulation material.

Figure 3:
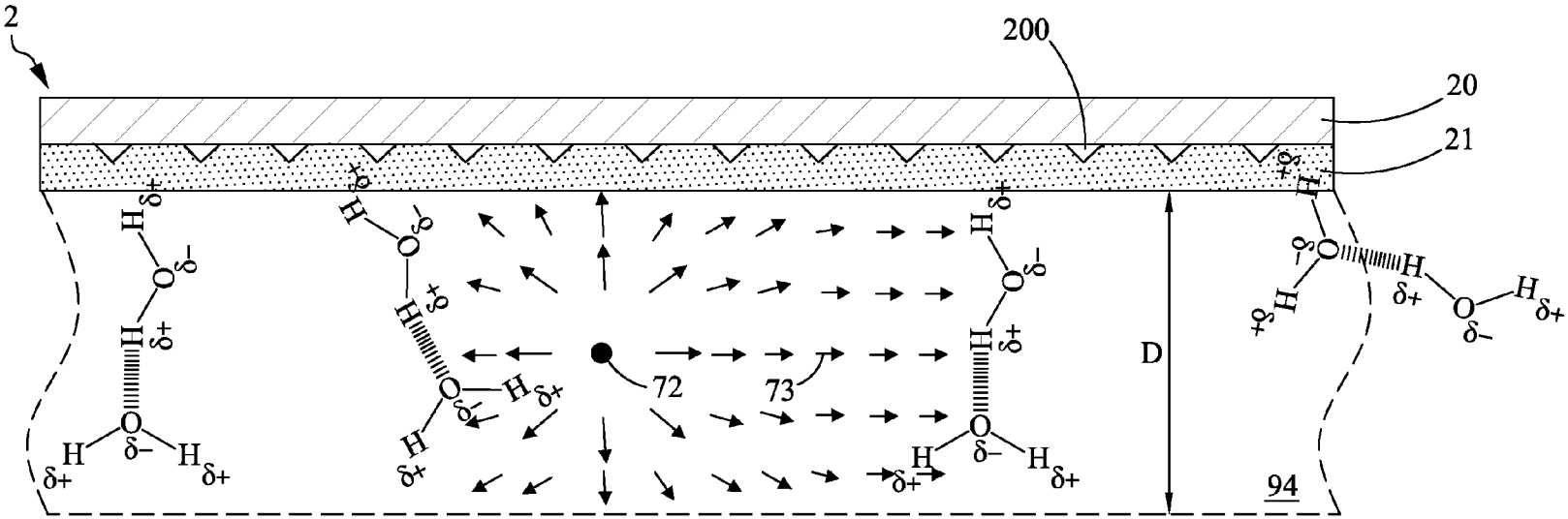
FIG. 3 is a schematic diagram showing how the attraction of the moisture absorber to polar water molecules is electrically interrupted and reduced by the corona layer formed on the surface of the moisture absorber in the present disclosure.

In FIG. 5, a space 74 represents an environment provided for the moisture absorber to be desorbed and regenerated, which can be an outdoor environment or a space formed inside a desorption pipe. On the other hand, a space 75 represents an environment that is required to be dehumidified, which can be an indoor environment. Consequently, the rotation unit 31 is used for controlling the positions of the plural dehumidifiers 2 in a manner that when one dehumidifier 2 is saturated and required to be desorbed and regenerated after being positioned in the space 75 for a period of time for dehumidification, the rotation unit 31 will be enabled to rotate and move the saturated dehumidifier 2 out of the space 75 into the space 74 for enabling the same to be electrically connected with an electrode 220 of the power source 22 so as to regenerate the moisture absorber 21 of the dehumidifier 2 in a same way as indicated in FIG. 3, and then, similarly, after being regenerated, the dry dehumidifier 2 is being moved again by the rotation unit 31 into the space 75 for absorbing moisture.

Figure 6:
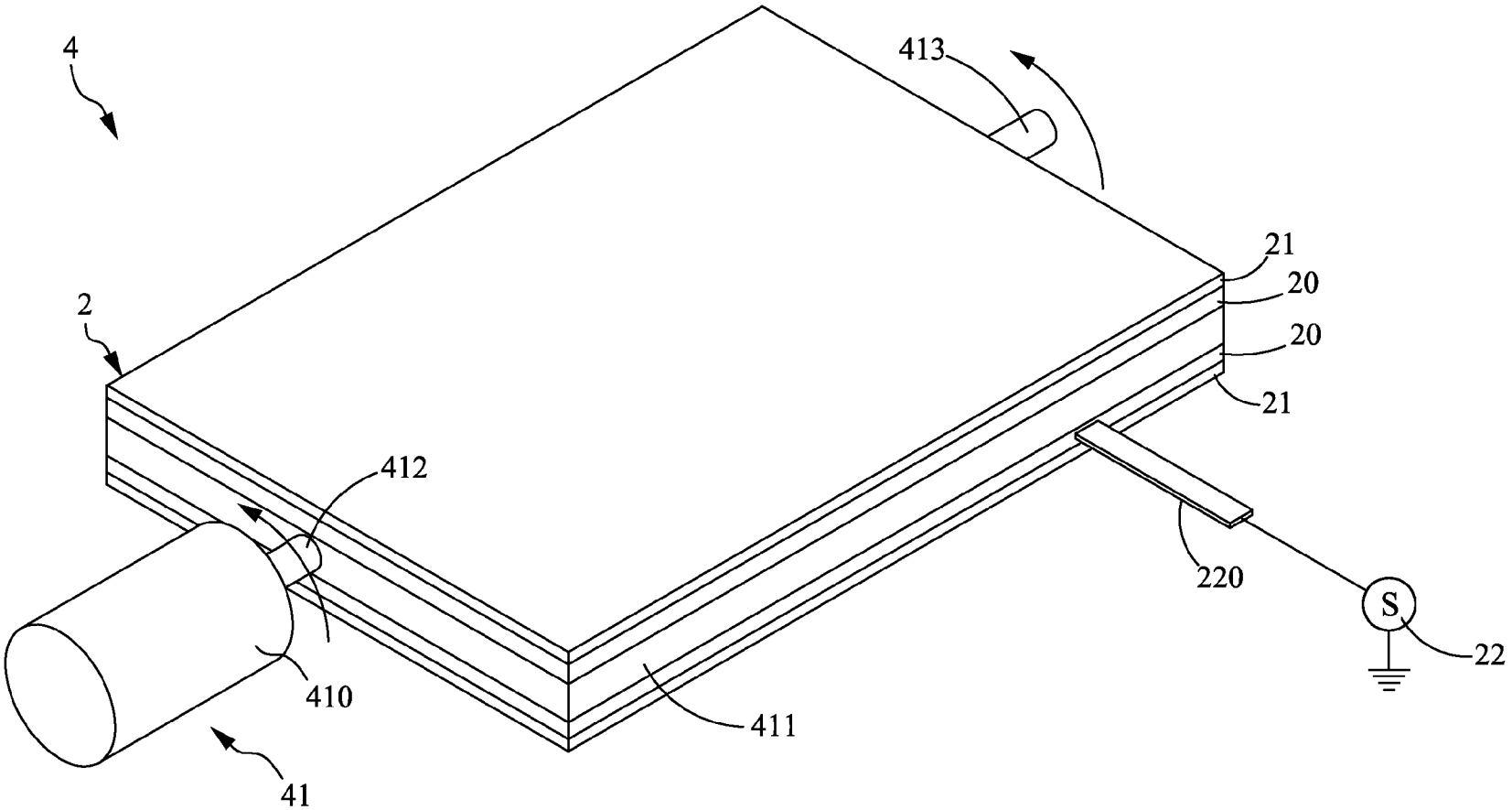
FIG. 6 is a schematic diagram showing dehumidification system with desorption ability according to a second embodiment of the present disclosure.

Please refer to FIG. 6, which is a schematic diagram showing dehumidification system with desorption ability according to a second embodiment of the present disclosure. In this second embodiment, the dehumidification system with desorption ability 4 comprises: a rotation unit 41; and a pair of dehumidifiers 2. As shown in FIG. 6, the rotation unit 41 comprises: a driver 410 and insulation layer 411, in which the insulation layer 411 is fixedly secured to a rotation shaft 412 of the driver 410 by a side thereof while allowing another opposite side to be configured with a rotation shaft 413 to be pivotally coupled to a fixed end; and the pair of the dehumidifiers 2 are arranged fixing to a top surface and a bottom surface of the insulation layer 411. In addition, there is a power source 22 fixedly arranged at a side of the insulation layer 411 that is specifically located for allowing only one of the two dehumidifiers 2 to electrically connect thereto. The system in this embodiment is operating the same as the one shown in FIG. 5. For instance, if the dehumidifier 2 that is attached to the top surface of the insulation layer 411 is used for absorption moisture, simultaneously the dehumidifier 2 that is attached to the bottom surface of the insulation layer 411 will be connected to the power source for regeneration, and when the dehumidifier 2 attached to the top surface is saturated, the driver 410 will be activated for driving the insulation layer to rotate and then enabling the saturated dehumidifier 2 on the top surface to switch with the regenerated dehumidifier 2 on the bottom surface for allowing the dehumidifier 2 on the top surface to be regenerated and the dehumidifier 2 on the bottom surface to absorb moisture.

Figure 7:
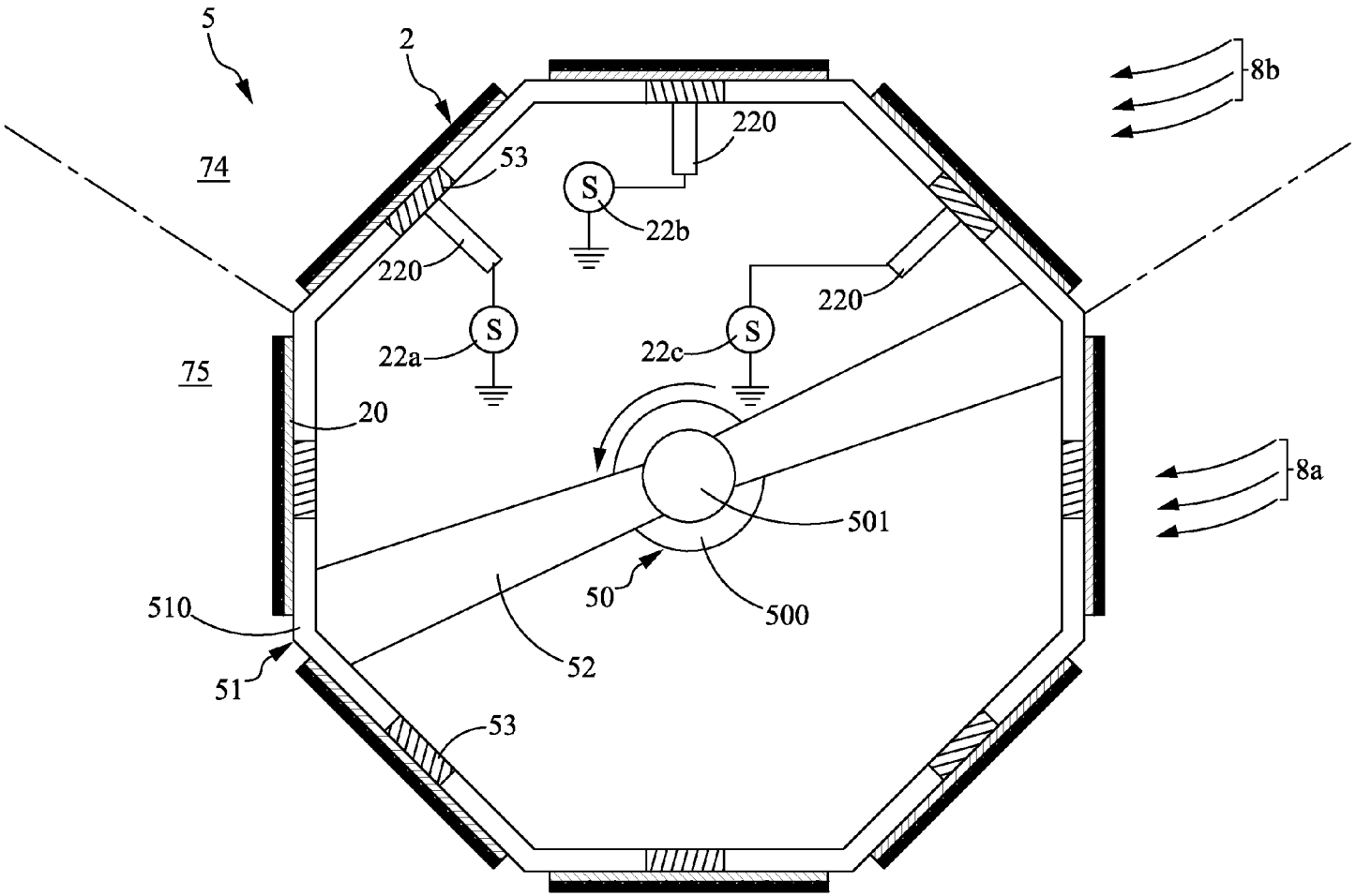
FIG. 7 is a schematic diagram showing dehumidification system with desorption ability according to a third embodiment of the present disclosure.

Please refer to FIG. 7, which is a schematic diagram showing dehumidification system with desorption ability according to a third embodiment of the present disclosure. In this third embodiment, the dehumidification system with desorption ability 5 comprises: a rotation unit 50, a polygon column 51 and a plurality of dehumidifiers 2. As shown in FIG. 7, the rotation unit 50 further comprises: a driver 500, a rotation shaft 501 and a supporting element. The polygon column 51, being made of an insulation material, is composed of a plurality of sidewalls 510, and each sidewall 510 is formed with a through hole that is provided for a conductive element 53 to fit therein. In this embodiment, the polygon column 51 is substantially an octagon column that is formed with eight sidewalls, but is not limited thereby and the amount of sidewall is determined according to actual requirement. As shown in FIG. 7, for each sidewall 510, there is at least one dehumidifier 2 being disposed corresponding thereto while allowing the conductive electrode 20 of the corresponding dehumidifier 2 to connect electrically with the conductive element 53 of the said sidewall 510. Moreover, the supporting element is composed of a plurality of insulated brackets 52, and the plural insulated brackets 52 are disposed inside the polygon column 51 in a manner that each of the plural brackets 52 is connected to the rotation shaft 501 by an end thereof while allowing another end thereof to coupled to the polygon column 51.

In addition, there are a plurality of stationary power sources 22*a*~22*c* to be disposed inside the polygon column 51 in a manner that each of the stationary power sources 22*a*~22*c* is electrically connected to one corresponding dehumidifier 2 selected from the plural dehumidifiers 2. Each of the plural power sources 22*a*~22*c* is structurally the same as those described hereinbefore, and thus will not be described further herein. Similarly, a space 74 represents an environment provided for moisture absorbers to be desorbed and regenerated, which can be an outdoor environment or a space formed inside a desorption pipe where any number of the dehumidifiers 2 that are situated therein will be electrically connected to the corresponding stationary power sources 22*a*~22*c*. On the other hand, a space 75 represents an environment that is required to be dehumidified, which can be an indoor environment. The amount of dehumidifiers 2 that are situated inside the space 74 and the amount of dehumidifiers 2 that are situated inside the space 75 will be determined according to actual requirement, and are not limited by the third embodiment shown in FIG. 7. As shown in FIG. 7, operationally, the driver 500 will be activated to rotation clockwisely or counterclockwisely every other specific period of time. In this embodiment, the driver 500 is activated to rotate counterclockwisely by 45 degrees. Consequently, the polygon column 51 will be brought along to rotate by 45 degrees since the polygon column 51 is coupled to the driver 500 through the plural brackets 52, and thus, the positions of the dehumidifiers 2 will be changed according to the rotation of the polygon column 51 for allowing those dehumidifiers 2 that are originally connected to the power sources 22*a*~22*c* in the space 74 to moved into the space 75 and thus disconnect from the power sources 22*a*~22*c*, and those dehumidifiers 2 that are originally located in the space 75 to moved into the space 74 and thus connect with the power sources 22*a*~22*c*.

Figure 8:
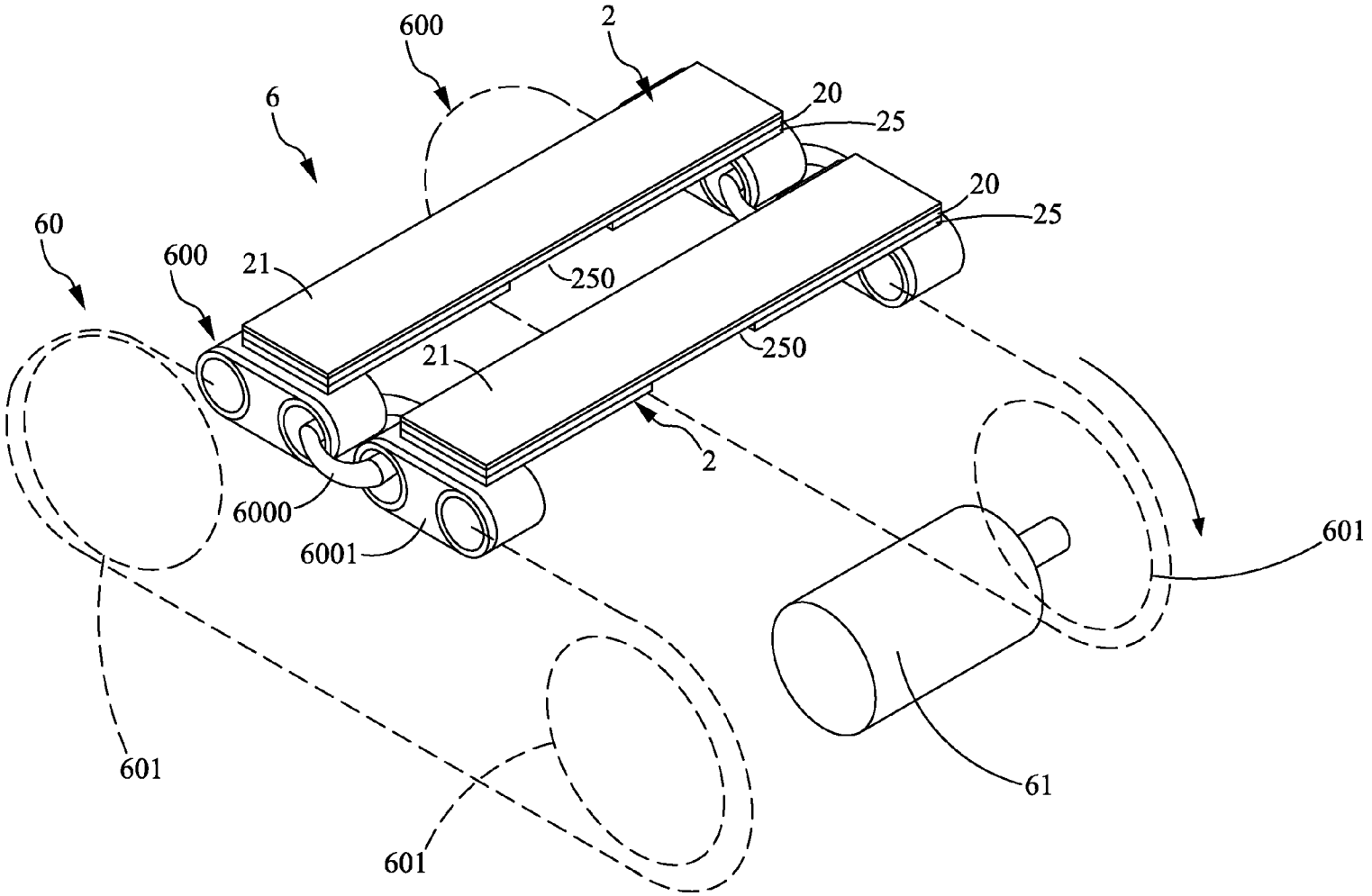
FIG. 8 is a schematic diagram showing dehumidification system with desorption ability according to a fourth embodiment of the present disclosure.

Please refer to FIG. 8, which is a schematic diagram showing dehumidification system with desorption ability according to a fourth embodiment of the present disclosure. In this fourth embodiment, the dehumidification system with desorption ability 6 comprises: a rotation unit 60; and a plurality of dehumidifiers 2. Moreover, the rotation unit 60 further comprises: a driver 61 and a supporting element, in which the supporting element is composed of a pair of chains 600 and a plurality of wheels 601, whereas each chain 600 is composed of a plurality of ring elements 6000 that are connected with each other by a plurality of buckles 6001, and each chain 600 is connected end to end as a loop that are mounted on any number of wheels 601 selected from the plural wheels 601 so as to be brought along to rotate accordingly as one of the plural wheels 601 is coupled to the driver 61 for allowing the wheels 601 to be driven to rotate. In this embodiment, the driver can be a motor. As shown in FIG. 8, for any one pair of ring elements 6000 that are disposed respectively on the two chains at positions corresponding to each other, there is a humidifier 2 selected from the plural dehumidifiers 2 to be mounted thereon, by that when the driver 61 is activated to drive the wheels 601 to rotate and consequently bring along the chain 600 to rotate accordingly, the dehumidifiers 2 mounted on the chains 600 will be moved and thus the positions of the dehumidifiers 2 are changed. As shown in FIG. 8, each dehumidifier 2 is engaged to its corresponding ring elements 6000 through an insulation layer 25, whereas the insulation layer each dehumidifier 2 is formed with a gap 250 for exposing a portion of the conductive electrode 20 in the dehumidifier 2 and thus enabling the conductive electrode 20 to connect electrically to a high-voltage power source through the gap 250. Thereby, when one dehumidifier 2 is electrically connected to the high-voltage power source, it is energized for desorbing the moisture absorber 21 of the dehumidifier 2.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A device for desorption and dehumidification, comprising:

a conductive electrode, further comprising:

a first surface, being formed as a coarse surface; and a second surface, arranged opposite to the first surface;

a moisture absorber, further comprises:

a third surface, disposed engaging to the coarse first surface; and a fourth surface, arranged opposite to the third surface; and a power source, electrically connected to the conductive electrode for providing a voltage to the conductive electrode so as to induce a current to flow from the conductive electrode to a gas for creating a gas discharge event and consequently enabling a corona layer filled with a plurality of charged particles to be formed covering the fourth surface.

2. The device of claim 1, wherein the power source is substantially a high-frequency transformer capable of providing a voltage ranged between 3000V and 20000V.

3. The device of claim 1, wherein the corona layer is formed within a range extending upwardly and outwardly from the fourth surface in a direction perpendicular to the fourth surface by a corona distance.

4. The device of claim 3, wherein the corona distance is small than 2.5 cm.

5. The device of claim 1, further comprising:

a heating unit, disposing on the second surface for providing heat to the conductive electrode and then to be conducted to the moisture absorber.

6. The device of claim 5, wherein the heating unit is substantially a solar energy-absorbing film capable of absorbing and converting solar energy into heat.

7. The device of claim 5, wherein the heating unit further comprises:

a solar energy-absorbing film, for absorbing and converting solar energy into heat;

a heat-conducting plate, disposed engaging with the second surface; and a thermal conductive element, coupled to the solar energy-absorbing film and the heat-conducting plate for conducting the heat generated from the solar energy-absorbing film to the heat-conducting plate.

8. The device of claim 1, wherein the coarse surface is a surface selected from the group consisting of: a surface configured with a plurality of holes, a surface configured with a plurality of tapered structures, and a surface configured with a plurality of holes and tapered structures.

9. The device of claim 1, wherein the conductive electrode is formed in a shape selected from the group consisting of: a panel and a tube.

10. The device of claim 1, wherein the current from the conductive electrode for the gas discharge event is ranged within 500 mA.

11. A dehumidification system with desorption ability, comprising:

a rotation unit; and a plurality of dehumidifiers, respectively mounting on the rotation unit;

wherein, each of the plural dehumidifiers further comprises:

a conductive electrode, being formed with: a first surface, being formed as a coarse surface; and a second surface, arranged opposite to the coarse first surface;

a moisture absorber, being formed with: a third surface, disposed engaging to the coarse first surface; and a fourth surface, arranged opposite to the third surface; and a power source, electrically connected to the conductive electrode for providing a voltage to the conductive electrode so as to induce a current to flow from the conductive electrode to a gas for creating a gas discharge event and consequently enabling a corona layer filled with a plurality of charged particles to be formed covering the fourth surface.

12. The dehumidification system with desorption ability of claim 11, wherein the power source is substantially a high-frequency transformer capable of providing a voltage ranged between 3000V and 20000V.

13. The dehumidification system with desorption ability of claim 11, wherein the corona layer is formed within a range extending upwardly and outwardly from the fourth surface in a direction perpendicular to the fourth surface by a corona distance.

14. The dehumidification system with desorption ability of claim 13, wherein the corona distance is small than 2.5 cm.

15. The dehumidification system with desorption ability of claim 11, further comprising:

a heating unit, disposing on the second surface for providing heat to the conductive electrode and then to be conducted to the moisture absorber.

16. The dehumidification system with desorption ability of claim 15, wherein the heating unit is substantially a solar energy-absorbing film capable of absorbing and converting solar energy into heat.

17. The dehumidification system with desorption ability of claim 15, wherein the heating unit further comprises:

a solar energy-absorbing film, for absorbing and converting solar energy into heat;

a heat-conducting plate, disposed engaging with the second surface; and a thermal conductive element, coupled to the solar energy-absorbing film and the heat-conducting plate for conducting the heat generated from the solar energy-absorbing film to the heat-conducting plate.

18. The dehumidification system with desorption ability of claim 11, wherein the rotation unit further comprises:

a driver, for providing a force of rotation; and a supporting element, coupled to the driver for receiving the force of rotation while being provided for supporting the plural dehumidifiers.

19. The dehumidification system with desorption ability of claim 18, wherein the supporting element is a formed as a device selected from the group consisting of: a rod, a polygon column and a chain conveyer.

20. The dehumidification system with desorption ability of claim 11, wherein the coarse surface is a surface selected from the group consisting of: a surface configured with a plurality of holes, a surface configured with a plurality of tapered structures, and a surface configured with a plurality of holes and tapered structures.

21. The dehumidification system with desorption ability of claim 11, wherein the conductive electrode is formed in a shape selected from the group consisting of: a panel and a tube.

22. The dehumidification system with desorption ability of claim 11, wherein the current from the conductive electrode for the gas discharge event is ranged within 500 mA.

* * * * *